US006047043A

United States Patent [19]

Kamps

[11] Patent Number: 6,047,043

[45] Date of Patent: Apr. 4, 2000

[54] X-RAY EXAMINATION APPARATUS INCLUDING AN EXPOSURE CONTROL SYSTEM

[75] Inventor: Hubert A. J. Kamps, Eindhoven, Netherlands

[73] Assignee: U.S. Philips Corporation, New York, N.Y.

[21] Appl. No.: 09/061,816

[22] Filed: Apr. 16, 1998

[30] Foreign Application Priority Data

Apr. 24, 1997 [EP] European Pat. Off. ..... 97201222

[51] Int. Cl.[7] ..... H05G 1/64

[52] U.S. Cl. ..... 378/98.7; 378/98.8; 378/98.12

[58] Field of Search ..... 378/98.7, 98.8, 378/98.12

[56] References Cited

U.S. PATENT DOCUMENTS 5,012,504 4/1991 McFaul et al. ..... 378/108
5,461,658 10/1995 Joosten ..... 378/98.7
5,574,764 11/1996 Granfors et al. ..... 378/98.7
5,675,624 10/1997 Relihan et al. ..... 378/98.7
5,694,449 12/1997 Aragones ..... 378/115

FOREIGN PATENT DOCUMENTS

0635804A1 1/1995 European Pat. Off. .

*Primary Examiner*—David V. Bruce
*Assistant Examiner*—Michael J. Schwartz
*Attorney, Agent, or Firm*—Dwight Renfrew

[57] ABSTRACT

An X-ray examination apparatus includes an X-ray detector (1) for deriving an image signal from an X-ray image and an exposure control system (2) for adjustment of the X-ray examination apparatus. The exposure control system includes an arithmetic unit (4) for forming a histogram of brightness values of the X-ray image and for deriving therefrom an image component which relates mainly to brightness values representing relevant image information. The exposure control system is arranged to adjust the X-ray examination apparatus on the basis of the image component.

13 Claims, 1 Drawing Sheet

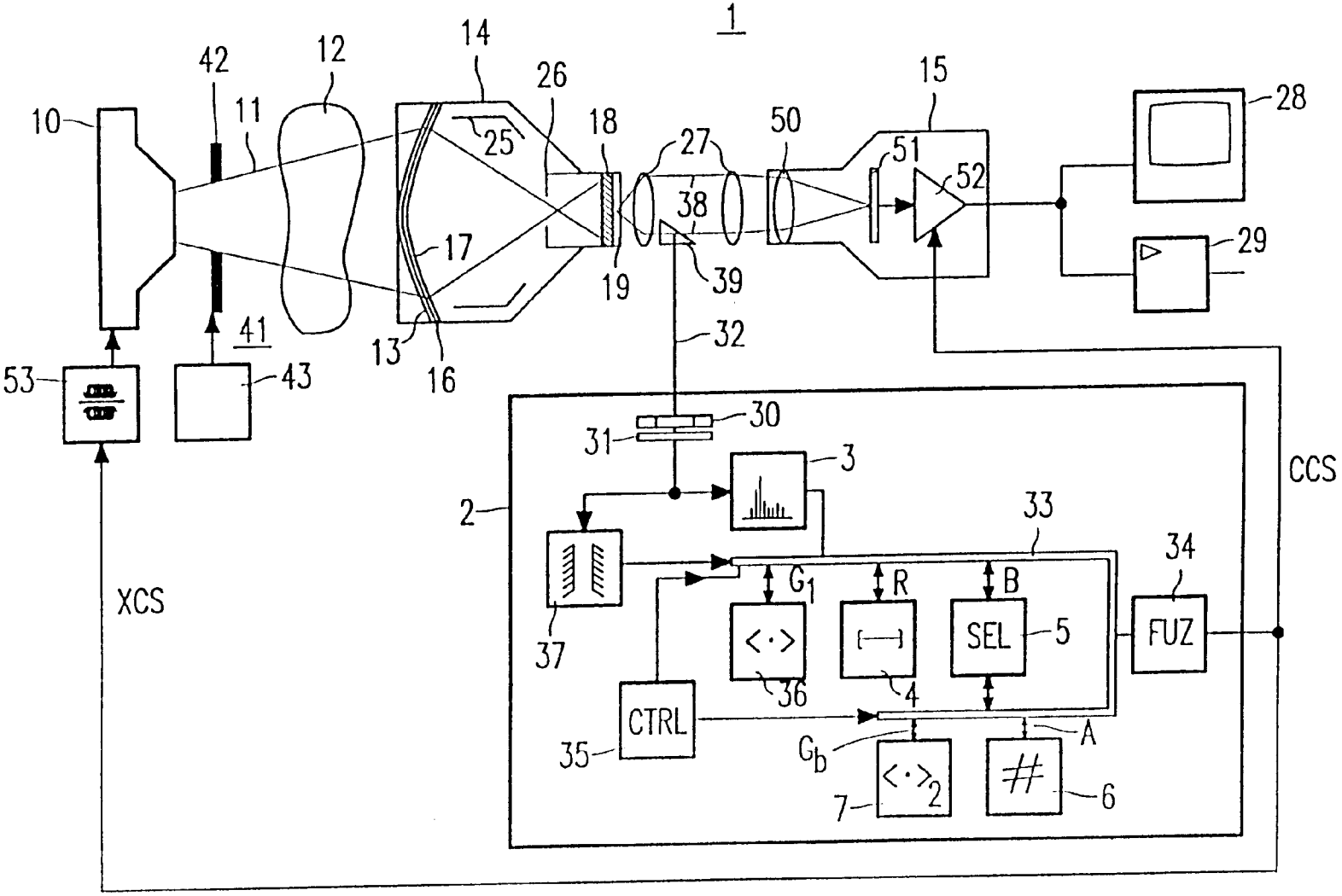
CCS
XCS
FUZ
SEL
CTRL
A
B
R
G1
Gb

X-RAY EXAMINATION APPARATUS INCLUDING AN EXPOSURE CONTROL SYSTEM

The invention relates to an X-ray examination apparatus which includes an X-ray detector for receiving an X-ray image and an exposure control system for adjustment of the X-ray examination apparatus. The invention also relates to an X-ray examination apparatus provided with an X-ray detector for deriving an optical image from an X-ray image and an exposure control system which is provided with a photodetector for measuring brightness values of the optical image and is arranged to adjust the X-ray examination apparatus.

An X-ray examination apparatus of this kind is known from U.S. Pat. No. 5,461,658.

The X-ray examination apparatus includes an X-ray source for irradiating an object to be examined, for example a patient to be radiologically examined, by means of an X-ray beam. Due to local differences in the X-ray absorptivity within the patient, an X-ray image is formed on an X-ray sensitive surface of the X-ray detector. The X-ray detector derives an image signal from the X-ray image. The image signal is, for example an electronic video signal whose signal levels represent brightness values of the X-ray image. The known X-ray examination apparatus includes an X-ray image intensifier for deriving an optical image from the X-ray image. The known X-ray examination apparatus also includes a television camera for deriving the electronic video signal from the optical image. Relevant image information in the X-ray image has a range which is usually much smaller than the range of the brightness values of the entire X-ray image. If no steps were taken, the values of the signal level of the image signal would not be suitable for further processing of the image signal so as to achieve suitably visible reproduction of the image information of the X-ray image.

The known X-ray examination apparatus includes an auxiliary light detection system which acts as an exposure control system. The auxiliary light detection system includes a CCD sensor for locally measuring the brightness in the optical image. The exposure control system derives a control signal from the measured brightness values, said control signal being used to adjust the X-ray apparatus in such a manner that an X-ray image of high diagnostic quality is formed and displayed, i.e. that small details are included in the X-ray image and suitably visibly reproduced. The auxiliary light detection system adjusts the X-ray examination apparatus in such a manner that the signal levels representing relevant image information have values which are suitable for reproducing the relevant image information with a high diagnostic quality. The control signal controls the intensity and/or the energy of the X-ray beam. The control signal can also be used to control the amplification of the image signal. Both steps influence the signal level of the image signal directly or indirectly.

The auxiliary light detection system of the known X-ray examination apparatus utilizes local brightness values in the optical image in order to adjust, for example the X-ray source, but it does not always take into account the fact that overexposed areas of high brightness occur in the optical image. Such overexposed areas are caused, for example by X-rays which are not or only hardly attenuated by the object to be examined, for example a patient. These are X-rays which have not passed through the patient or have traversed tissue having a low X-ray absorptivity, for example lung tissue. Such overexposed areas contain hardly any or even no image information, but could have an adverse effect on the adjustment of the known X-ray examination apparatus.

It is an object of the invention to provide an X-ray examination apparatus which includes an exposure control system which is better suitable for adjusting the X-ray examination apparatus on the basis of relevant information in the X-ray image.

This object is achieved by means of an X-ray examination apparatus according to the invention which is characterized in that the exposure control system includes an arithmetic unit for forming a histogram of brightness values of the X-ray image and for deriving an image component therefrom which relates mainly to brightness values representing relevant image information, and in that the exposure control system is arranged to adjust the X-ray examination apparatus on the basis of the image component.

For separate intervals of brightness values, the histogram contains respective numbers of pixels of the X-ray image having a brightness value in a relevant interval. An image component and a high-brightness component are distinguished in the histogram. The image component comprises mainly brightness values concerning relevant image information. The high-brightness component comprises mainly brightness values of overexposed areas. The image component comprises the respective numbers of pixels having a brightness value below a limit value and the high-brightness component comprises the respective numbers of pixels with a brightness value above the limit value. Because the exposure control system adjusts the X-ray examination apparatus on the basis of the image component, it is achieved that overexposed areas in the X-ray image have hardly any or no effect on the adjustment.

A preferred embodiment of an X-ray examination apparatus is defined in claim 2. The mean value of brightness values of the entire X-ray image represents a suitable limit value for distinguishing the image component and the high-brightness component from one another in the histogram. It has been found that brightness values below said mean value relate mainly to image information.

A preferred embodiment of an X-ray examination apparatus is defined in claim 3. It has been found that a relative magnitude of overexposed areas in the X-ray image can be accurately deduced on the basis of said number and said range. Because the exposure control system takes into account the relative magnitude of overexposed areas in the X-ray image, the detrimental effects of said overexposed areas on the adjustment are avoided even better.

A preferred embodiment of an X-ray examination apparatus is defined in claim 4. Fuzzy logic is a control technique capable of taking decisions by means of linguistic (if-then) rules. These rules contain knowledge and/or experience gathered (by humans) by using a control system. These knowledge rules can be fed with concrete input variables. The values of the input variables are arranged in given ranges, each of which is designated by a respective label. These labels correspond to the linguistic variables representing the knowledge. Distribution functions are associated with individual labels. Concrete input variables are linked to a given input label on the basis of such distribution functions. From the input label and the knowledge rules there is derived an output label wherefrom a concrete output variable is derived by means of the distribution functions. The use of fuzzy logic for controls in general is known per se from the book "Fuzzy set theory and its applications" by H. J. Zimmermann.

Distribution functions are experimentally defined for the number of clusters and the cluster size in order to implement the fuzzy logic rules. It has been found in practice that on the basis of fuzzy logic rules the X-ray examination apparatus according to the invention is adjusted better than the known apparatus.

Preferred embodiments of an X-ray examination apparatus are defined in the claims 5 and 6. Brightness values in a small range around the mean brightness of the image component of the histogram constitute a comparatively accurate estimate of the brightness values of the X-ray image in as far as they represent image information. Adjustment of the X-ray examination apparatus on the basis of the mean brightness of the image component and/or brightness values near said mean brightness yields an image signal hereby the image information can be suitably visibly reproduced.

A preferred embodiment of an X-ray examination apparatus is defined in claim 7. Filter and/or collimator elements cause areas of low brightness in the X-ray image. Such areas of low brightness, i.e. the masked areas, do not contain relevant image information but can contribute to the image component of the histogram. When such masked areas are detected by means of the detection system and excluded from the derivation of the histogram, the image component will relate substantially exclusively to relevant image information. The adverse effects of the detected masked areas on the adjustment of the X-ray examination apparatus are thus avoided.

Methods of detecting areas in the X-ray image which relate to filter and/or collimator elements are known per se from European patent application EP 0 635 804 (PHQ 93.103). Steps for detecting areas in the X-ray image in which filter and/or collimator elements are reproduced are attractive per se; they are notably independent of the adjustment of the X-ray examination apparatus, for example in order to prevent reproduction of the detected masked areas in the X-ray image. A preferred embodiment of an X-ray examination apparatus is defined in claim 8. Areas in the X-ray image in which a filter or collimator element is reproduced have an edge to both sides of which the brightness values differ significantly. In many applications filter and/or collimator elements are arranged to both sides of and symmetrically with respect to the X-ray beam. Local maximum gradients of the brightness values with positions situated symmetrically relative to the predetermined position, preferably the center of the X-ray image, often relate to such an edge of a masked area. Therefore, notably in applications where filter and/or collimator elements are symmetrically arranged in the X-ray beam, such a masked area of the X-ray image in which filter and/or collimator elements are reproduced can be detected without very complex calculations being required. Preferably, the brightness values of the X-ray image are arranged in an image matrix and local maximum gradients are derived from differences between sums of brightness values of individual columns and/or rows of the image matrix.

A preferred embodiment of an X-ray examination apparatus is defined in claim 9. Image information relating to the anatomy of the patient to be examined is distinguished from masked areas on the basis of this comparison. Notably an X-ray image showing filter and/or collimator elements is distinguished from an X-ray image in which both legs of the patient are reproduced.

A preferred embodiment of an X-ray examination apparatus is defined in claim 10. The optical image corresponds to the X-ray image, i.e. the brightness values of the X-ray image correspond to the brightness values of the optical image. Consequently, adjustment of the X-ray examination apparatus on the basis of the histogram offers the same results when the histogram is formed from brightness values of the optical image or directly from brightness values of the X-ray image.

The functions of the exposure control system in a contemporary X-ray examination apparatus are preferably executed by means of a suitably programmed computer or a special-purpose (micro)processor.

Citation of a reference herein, or throughout this specification, is not to construed as an admission that such reference is prior art to the Applicant's invention of the invention subsequently claimed.

These and other aspects of the invention will be described in detail hereinafter on the basis of the following embodiments and with reference to the accompanying drawing which shows diagrammatically an X-ray examination apparatus in which the invention is used.

The X-ray examination apparatus includes an X-ray source 10 for irradiating an object 12 to be examined, for example a patient to be radiologically examined, by means of an X-ray beam 11. Due to local differences in the X-ray absorption within the patient an X-ray image is formed on an X-ray-sensitive surface 13 of the X-ray detector 1. The x-ray detector derives an image signal, e.g. an electronic videosignal, from the x-ray image. The X-ray detector 1 is an image intensifier pick-up chain which includes an X-ray image intensifier 14 and a television camera 15. The X-ray-sensitive surface is a conversion layer 13 of an entrance screen 16 of the X-ray image intensifier.

The X-rays incident on the entrance screen 16 are converted into blue or ultraviolet light in the conversion layer 13. The entrance screen 16 includes a photocathode 17 which is sensitive to the blue or ultraviolet light of the conversion layer 13. The blue or ultraviolet light of the conversion layer releases an electron beam in the photocathode, said electron beam being guided to a phosphor layer 18 on an exit window 19 by means of an electron optical system. The electron optical system includes the photocathode 17, alignment electrodes 25 and an anode 26. The electron optical system images the photocathode 17 on the phosphor layer 18 on the exit window 19. The incident electrons produce an optical image of, for example visible or infrared light in the phosphor layer 18. The television camera 15 derives an image signal, notably an electronic video signal, from the optical image. To this end, the television camera 15 is optically coupled to the exit window 19 by means of a lens system 27. The optical image on the exit window is imaged on an image sensor 51, for example a charged coupled (CCD) image sensor, by means of the lens system and the camera lens 50. The lens system 27 collects the light from the exit window 19, forms a substantially parallel light beam 38 and, in conjunction with the camera lens 50, focuses said parallel light beam on the image sensor 51. The image sensor converts the incident light into an electric charge and derives electric voltages from said electric charge. A variable amplifier 52 derives the electronic video signal from said electric voltages. The electronic video signal is applied to a monitor 28 or to a buffer unit 29. The image information contained in the X-ray image is reproduced on the monitor 28. The image signal stored in the buffer unit 29 can be processed at a later stage.

The X-ray examination apparatus includes an exposure control system 2 with an image detector 30 which picks up the optical image on the exit window. This is realized, for example by guiding a sub-beam 32 from the light beam 38 to the image detector 30 by means of an optical element 39 such as a splitting prism or a partly reflective mirror. The image detector is, for example a charged coupled (CCD) image detector. The image detector 30 derives an electronic detector signal, representing brightness values in the optical image, from the optical image. The electronic detector signal is read from the image detector by means of a read circuit 31 so as to be digitized and applied to the arithmetic unit 3. The arithmetic unit 3 derives the histogram of brightness values in the optical image from the digital electronic detector signal. To this end, respective numbers of signal levels are counted in small intervals. Because the detector signal represents brightness values in the optical image and the optical image corresponds to the X-ray image, said numbers of signal levels represent the numbers of pixels in the X-ray image with brightness values in respective intervals.

Via a bus 33, the histogram is applied to a fuzzy logic unit 34 which forms a camera control signal CRS and an X-ray control signal XCS on the basis of the histogram. The fuzzy logic unit 34 applies the camera control signal to a control terminal 54 of the amplifier 52 of the television camera. The camera control signal adjusts the amplifier 52 to a suitable gain so as to ensure that relevant image information is clearly reproduced by the electronic video signal, notably that small details of low contrast are reproduced in a suitably visible manner. In particular such a gain is adjusted that underexposure and overexposure of relevant image information is avoided in the rendition of the X-ray image. The fuzzy logic unit 34 applies the X-ray control signal to a high voltage supply 53. The X-ray control signal adjusts the intensity and the energy of the X-ray beam 11 in such a manner that relevant image information in the X-ray image is represented by brightness values which can be suitably processed so as to achieve clear reproduction of relevant image information.

A mean value calculator 36 calculates a mean value $G_1$ of all or practically all signal levels in the histogram. A range-determining device 4 determines the range R of (essentially) all signal levels in the histogram; to this end, the range-determining device 4 searches the highest and lowest values of the signal levels of the histogram. A selection unit 5 derives the image component of the histogram; to this end, the numbers of pixels for which the signal level is below the mean value $G_1$ are selected. A counter 6 counts the number of pixels in the image component and the number in the complete histogram. The counter 6 derives the part A of the pixels in the image component from said number; A is the ratio of the number of pixels in the image component to the number of pixels of the complete histogram.

The fuzzy logic unit 34 derives the camera control signal and the X-ray control signal from the image component B and the range R on the basis of fuzzy logic rules. The fuzzy logic unit derives the desired camera and X-ray control signals from the part A and the range R on the basis of fuzzy logic rules. The fuzzy logic checks, on the basis of the fuzzy logic rules, whether the image component of the histogram possibly includes an overexposed part, and it also determines the magnitude thereof in the X-ray image. For example, if the range R is not larger than approximately $1/6^{th}$ part of the range of the brightness values of the complete X-ray image and the part A is larger than approximately 0.55, the camera and X-ray control signals will not or only slightly change the adjustment of the X-ray examination apparatus. In this situation high brightness values in the X-ray image can be attributed almost exclusively to overexposure and the brightness values relating to relevant image information are contained in a range which can be readily processed so as to achieve suitably visible reproduction of the image information. When the range R is between $1/6^{th}$ part and $1/3^{rd}$ part of the range of the brightness values of the complete X-ray image and the part A lies between approximately 0.35 and 0.55, the camera and X-ray control signals provide a comparatively small reduction of the signal levels of the image signal. This is because it has been found that in this situation high brightness values are not only due to overexposure and that relevant image information is contained in brightness values which are slightly too high for suitable processing. When the range R amounts to more than one quarter of the range of the brightness values of the complete X-ray image and the part A amounts to less than 0.15, the camera and X-ray control signals provide a rather substantial reduction of the signal levels of the image signal. This is because it has been found that in this situation high brightness values can hardly be attributed to overexposure and that relevant image information is contained in brightness values which are much too high for suitable processing. If desired, various situations which are characterized by (possibly overlapping) intervals for values of the range R and the part A can be distinguished in more detail. The fuzzy logic unit 34 derives the camera and X-ray control signals on the basis of the values of A and R in conformity with fuzzy logic rules.

Inter alia on the basis of the mean signal level $G_b$ a second mean value calculator 7 calculates the mean signal level $G_b$ of the image component. The fuzzy logic unit provides the camera and X-ray control signals. Thus, such an adjustment of the X-ray examination apparatus is obtained that relevant image information, for example relating to an organ of the patient to be examined, is clearly reproduced. On the basis of fuzzy logic rules, the fuzzy logic unit 34 specifically derives from the mean signal $G_b$ of the image component with the range R and the part A a value near $G_b$ which accurately corresponds to brightness values relating to relevant image information. For example, when the range R is small, approximately 90 of a maximum of 256 signal level values, and if the image component comprises a small part A, being approximately one tenth of the pixels of the histogram, it appears that there are hardly any overexposed areas in the X-ray image and the fuzzy logic unit adjusts the corrected value $G_b'$, to be no less than 5% higher than $G_b$. Furthermore, if the range R is not small, the fuzzy logic unit supplies camera and X-ray control signals which are dependent on the part A of the pixels of the histogram in the image component. For example, if A is small, for example between 0 and 0.2, the fuzzy logic unit derives a value $G_b'$ which is a few percents higher than $G_b$. For example, if A is very large, for example between 0.3 and 0.7, the fuzzy logic unit 34 derives a value $G_b'$ which is approximately 5% lower than $G_b$. The value $G_b'$ lies in a small interval around $G_b$ and may be considered to be a correction of $G_b$ in order to achieve a further reduction of the effects of overexposed areas in the X-ray image.

The exposure control system 2 also includes a detection system 37 for the detection of one or more areas in the X-ray image in which collimator elements or filter elements are reproduced. A collimator/filter unit 41 intercepts or partly attenuates a part of the X-ray beam 11. To this end, the collimator/filter unit 41 includes collimator elements 42 which absorb X-rays substantially completely and filter elements 42 which partly absorb parts of a given energy of the X-ray beam. Using an adjusting unit 43, the collimator elements 42 are arranged in the X-ray beam in such a manner that essentially a part of the patient to be examined is irradiated by the X-ray beam. The filter elements are arranged in the X-ray beam in such a manner that the amount of X-rays of high energy reaching low-absorption parts of the patient is not excessive.

The data transport and the communication in the exposure control system take place via the bus 33 and are controlled by a control unit 35.

All references cited herein are incorporated herein by reference in their entirety and for all purposes to the same extent as if each individual publication or patent or patent application was specifically and individually indicated to be incorporated by reference in its entirety for all purposes.

I claim:

1. An X-ray examination apparatus comprising:

an adjustable X-ray source for forming an X-ray image, an adjustable X-ray detector for receiving an X-ray image, and an exposure control system for adjustment of the X-ray examination apparatus, wherein the exposure control system includes an arithmetic unit for forming a histogram of brightness values of the X-ray image, and for deriving from the histogram an image component of the histogram which comprises numbers of pixels having brightness values representing relevant image information, and wherein the exposure control system adjusts the X-ray examination apparatus on the basis of the image component of the histogram.

2. An X-ray examination apparatus as claimed in claim 1 wherein the image component of the histogram comprises the numbers of pixels having brightness values below a mean value of brightness values of substantially the entire X-ray image.

3. An X-ray examination apparatus as claimed claim 1 wherein the arithmetic unit is further for deriving from the histogram a high-brightness component of the histogram, and for calculating the range of brightness values of the complete X-ray image and a number of pixels of the X-ray image having a brightness value in a high-brightness component, and wherein the exposure control system adjusts the X-ray examination apparatus on the further basis of said number and said range.

4. An X-ray examination apparatus as claimed in claim 3 wherein the exposure control system adjusts the X-ray examination apparatus on the further basis of fuzzy logic rules applied to said number of pixels and said range.

5. An X-ray examination apparatus as claimed in claim 1 wherein the exposure control system adjusts the X-ray examination apparatus on the further basis of a mean brightness value of the image component of the histogram.

6. An X-ray examination apparatus as claimed in claim 5 wherein the exposure control system adjusts the X-ray examination apparatus on the further basis of brightness values in an interval of the histogram, said interval being substantially smaller than the range of brightness values of the complete X-ray image and containing the mean brightness value of the image component of the histogram.

7. An X-ray examination apparatus as claimed in claim 1 wherein the exposure control system further comprises a detection system for detecting a masked part of the X-ray image in which a filter or collimator element of the X-ray examination apparatus is reproduced, and wherein the exposure control system adjusts the X-ray examination apparatus on the further basis of a part of the X-ray image which is situated outside such a detected part.

8. An X-ray examination apparatus as claimed in claim 7 wherein the detection system is further for determining maximum gradients of brightness values, said maximum gradients of brightness values representing local maximum variations in a predetermined direction in the X-ray image, and for determining respective relative positions of the maximum gradients in the X-ray image in relation to a predetermined position in the X-ray image, and for deriving the masked part on the basis of the maximum gradients and their relative positions.

9. An X-ray examination apparatus as claimed in claim 8 wherein the detection system is further for comparing brightness values in a part of the X-ray image, situated between the positions of the maximum gradients, with brightness values of the image component of the histogram.

10. An X-ray examination apparatus comprising:

an adjustable X-ray source for forming an X-ray image, an adjustable X-ray detector for deriving an optical image from an X-ray image, and an exposure control system which includes a photodetector for measuring brightness values of the optical image and is arranged to adjust the X-ray examination apparatus, wherein the exposure control system includes an arithmetic unit for forming a histogram of brightness values of the optical image and for deriving from the histogram a high brightness component of the histogram and an image component of the histogram, and wherein the exposure control system adjusts the X-ray examination apparatus on the basis of the image component of the histogram.

11. The apparatus of claim 1 wherein the image component of the histogram comprises the numbers of pixels having brightness values below a limit value.

12. The apparatus of claim 3 wherein the high-brightness component of the histogram comprises the numbers of pixels having brightness values above a limit value.

13. The method of claim 4 wherein the fuzzy logic rules comprise if-then rules.

* * * * *